US006278071B1

(12) United States Patent
Chen

(10) Patent No.: US 6,278,071 B1
(45) Date of Patent: Aug. 21, 2001

(54) WATERPROOF SWITCH IN A FLASHLIGHT

(76) Inventor: Han-Liang Chen, 1FL., No. 6-2, Lane 78, Sungchiang Rd., Taipei (TW)

( * ) Notice: Subject to any disclaimer, the term of this patent is extended or adjusted under 35 U.S.C. 154(b) by 0 days.

(21) Appl. No.: 09/596,221

(22) Filed: Jun. 19, 2000

(30) Foreign Application Priority Data

Aug. 16, 1999 (TW) ..... 088213845

(51) Int. Cl.[7] ..... F21L 7/00; H01H 9/04

(52) U.S. Cl. ..... 200/302.1; 200/60; 200/332.2; 362/205

(58) Field of Search ..... 200/60, 520, 293.1, 200/295, 302.1, 302.2, 329, 332.1, 332.2, 341; 362/157, 158, 202, 204, 205

(56) References Cited

U.S. PATENT DOCUMENTS

| | | | | |
|---|---|---|---|---|
| 4,843,526 | * | 6/1989 | Price, III . | |
| 5,260,858 | * | 11/1993 | Maglica | 362/205 |
| 5,282,116 | * | 1/1994 | Shiau | 362/205 |
| 5,426,273 | * | 6/1995 | Shiau | 200/520 |
| 5,593,222 | * | 1/1997 | Maglica | 362/157 |
| 5,939,691 | * | 8/1999 | Shiau | 200/302.2 |

* cited by examiner

*Primary Examiner*—Michael Friedhofer
(74) *Attorney, Agent, or Firm*—Dellett and Walters

(57) ABSTRACT

A waterproof switch in a flashlight has a switch assembly, a waterproof bonnet received between the switch assembly and the hollow cylinder and an abutting member received in the switch assembly to force the switch assembly to move toward the waterproof bonnet to allow the switch assembly to have a waterproof engagement with the hollow cylinder.

9 Claims, 4 Drawing Sheets

WATERPROOF SWITCH IN A FLASHLIGHT

BACKGROUND OF THE INVENTION

1. Field of the Invention

The present invention relates to a waterproof switch, and more particularly to a waterproof switch in a flashlight. The waterproof switch is able to prevent the moisture in the air and water from going into the inner circuit of the torch to cause a short.

2. Description of Related Art

A flashlight usually is used by families for emergency occasions or by maintenance personnel to work on a dark working site or military personnel, policemen or even security guards. Because the flashlight can be used indoors or outdoors, it is quite handy to the users. However, when using the flashlight, the user might find that the connection of the circuit in the flashlight is short by the humidity. In some case, the flashlight might even fall into the water and therefore has a malfunction. To mitigate the problem, a waterproof flashlight is introduced to the market, which has a gasket both in the front portion and the rear portion of the flashlight, such that water or humidity in the air is prevented from going into the inside of the flashlight to cause a short. Still, because the switch of the flashlight protrudes out from the periphery of the flashlight and there is no any waterproof device provided to the switch, water or humidity in the air easily penetrates into the inside of the flashlight and causes a short.

To overcome the shortcomings, the present invention tends to provide a waterproof switch in a flashlight to mitigate and obviate the aforementioned problems.

SUMMARY OF THE INVENTION

The main objective of the invention is to provide a waterproof switch having a waterproof bonnet made of silicon and a switch seat configured to fit an inner periphery of the flashlight and for mounting switches thereon. The waterproof bonnet has flanges corresponding to the switches, such that each rod in each switch is able to be inserted into the flange for facilitating operation of the flashlight.

Still another objective of the invention is to provide a waterproof switch having an abutting member provided with an abutting plate, a forcing member engaged with the abutting plate and an enlarging element inserted through the forcing member to force the forcing member to securely abut an inner periphery of the flashlight so reach a watertight engagement.

Other objects, advantages and novel features of the invention will become more apparent from the following detailed description when taken in conjunction with the accompanying drawings.

DETAILED DESCRIPTION OF PREFERRED EMBODIMENT

Figure 1:
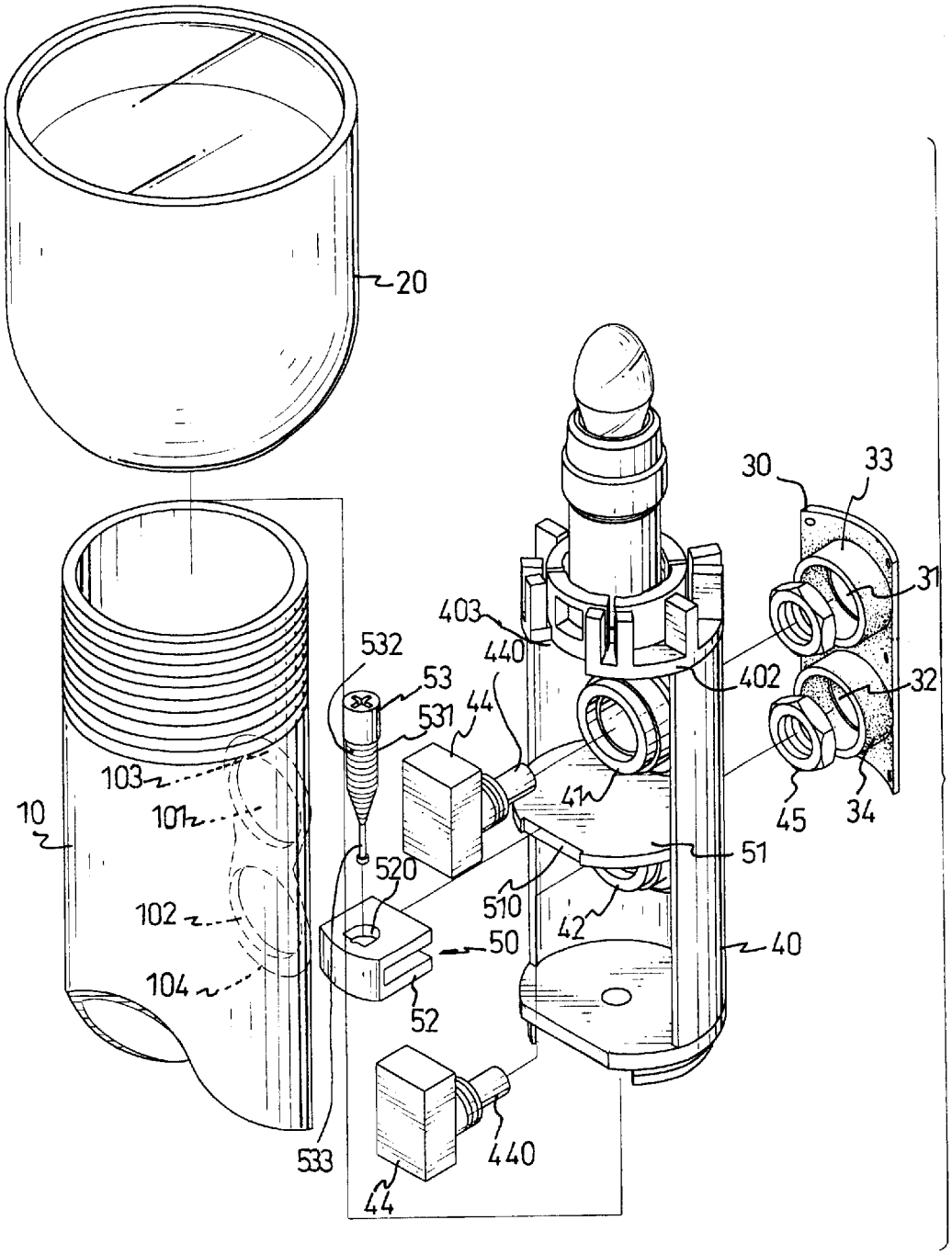
FIG. 1 is an exploded perspective view of the flashlight together with a waterproof switch constructed in accordance with the present invention.
Figure 2:
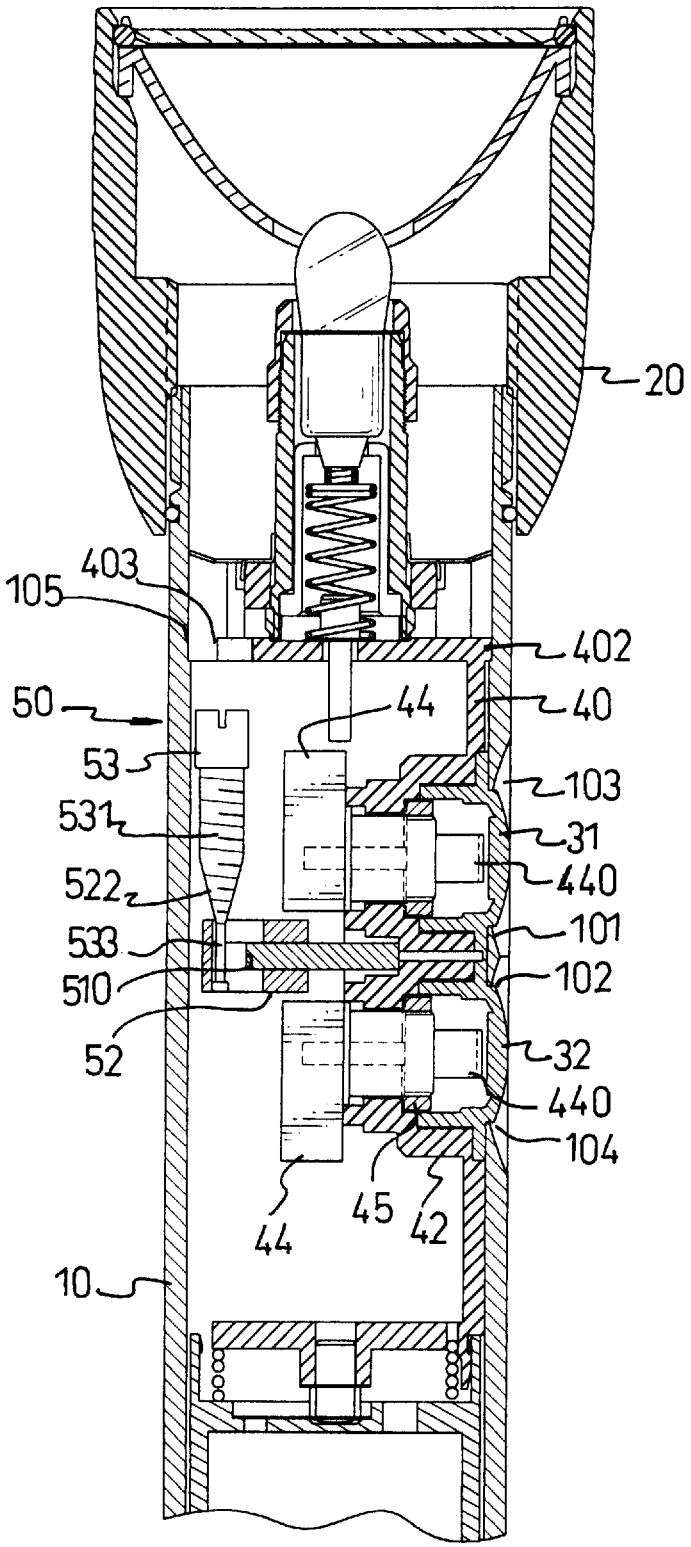
FIG. 2 is a side plan view in partial cross section of the flashlight in FIG. 1.

Referring to FIG. 1 and FIG. 2, a water proof switch is a flashlight is shown. The waterproof switch has a waterproof bonnet (30), a switch assembly (40) and an abutting member (50).

It is noted that a flashlight normally has a hollow cylinder (10) with a cap (20) on a top thereof. The cylinder (10) has a pair of through holes (101,102) defined to receive a pair of corresponding switches therein and each of the through holes (101,102) has a concave (103,104) in an outer periphery defining the respective through holes (101,102) and a shoulder (105) formed in an inner periphery of the cylinder (10).

The switch assembly (40) is received in the cylinder (10) and has a flange (402) formed on a top portion to abut the shoulder (105) of the cylinder (10) to limit the insertion of the switch assembly (40) into the cylinder (10) and provided with a cutout (403), a pair of holes (41,42) corresponding to the pair of through holes (101,102), a pair of switches (44) each corresponding to one of the pair of holes (41,42) and having an extension (440) integrally extending out therefrom and a pair of retainers (45) each corresponding to one of the extensions (440) and being provided to secure the location of the switches (44) after being inserted into the holes (41,42).

The waterproof bonnet (30) is made of waterproof material such as silicon and has a pair of arcuate surfaces (31,32) each with a rim (33,34) formed on opposite side to the arcuate surfaces (31,32).

The abutting member (50) includes a plate (51) integrally and laterally formed between the holes (41,42) and having a flat side (510), a forcing member (52) having the plate (51) received therebetween and a passage (520) defined therethrough and an enlarging element (53) with a large diameter portion (531), a medium diameter portion (532) and a small diameter portion (533).

When the waterproof switch of the invention is assembled, the arcuate surfaces (31,32) of the waterproof bonnet (30) are respectively inserted into the corresponding holes (41,42) with the rims (33,34) extending through the holes (41,42). Then the extensions (440) of the pair of switches (44) are respectively secured by the retainers (45) and received in the rims (33,34) respectively. Thereafter, the forcing member (52) is inserted between the two switches (44) and having the plate (51) received between the forcing member (52). Due to the flat side (510) on the plate (51), the forcing member (52) is able to have a tight engagement with the plate (51). After the forcing member (52) is secured with the plate (51), the enlarging element (53) is able to insert into the passage (520) from the cutout (403) of the switch assembly (40).

Figure 3:
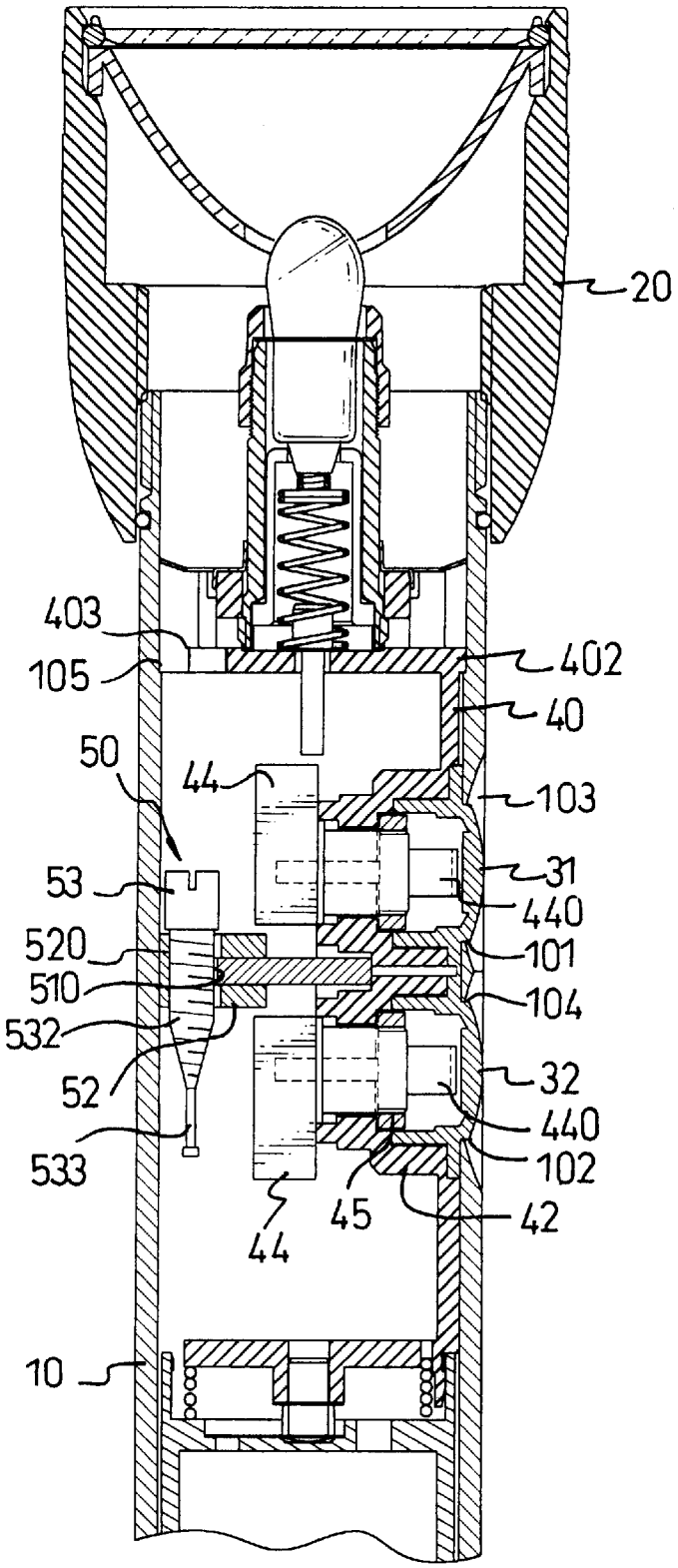
FIG. 3 is a side plan view in partial cross section of the pumping device in FIG. 1, wherein the enlarging element is inserted into the forcing member to force the forcing member to engage with an inner periphery of the flashlight.

Referring to FIG. 3, when the enlarging element (53) is gradually inserted into the passage (520), the small diameter portion (533), the medium diameter portion (532) and the large diameter portion (531) will gradually force the forcing member (52) to move against an inner periphery of the cylinder (10). When the forcing member (52) abuts the inner periphery of the cylinder (10), the movement of the enlarging element (53) into the passage (520) will then force the entire switch assembly (40) to move toward an inner periphery of the cylinder (10). At the same time, the arcuate surfaces (31,32) of the waterproof bonnet (30) are tightly received between the cylinder (10) and the switch assembly (40).

From the above description, it is noted that the movement of the enlarging element (53) will force the entire switch assembly to move against the cylinder (10) so as to secure the waterproof bonnet (30) between the cylinder (10) and the switch assembly (40). Therefore, the waterproof structure of the flashlight is enhanced.

Figure 4:
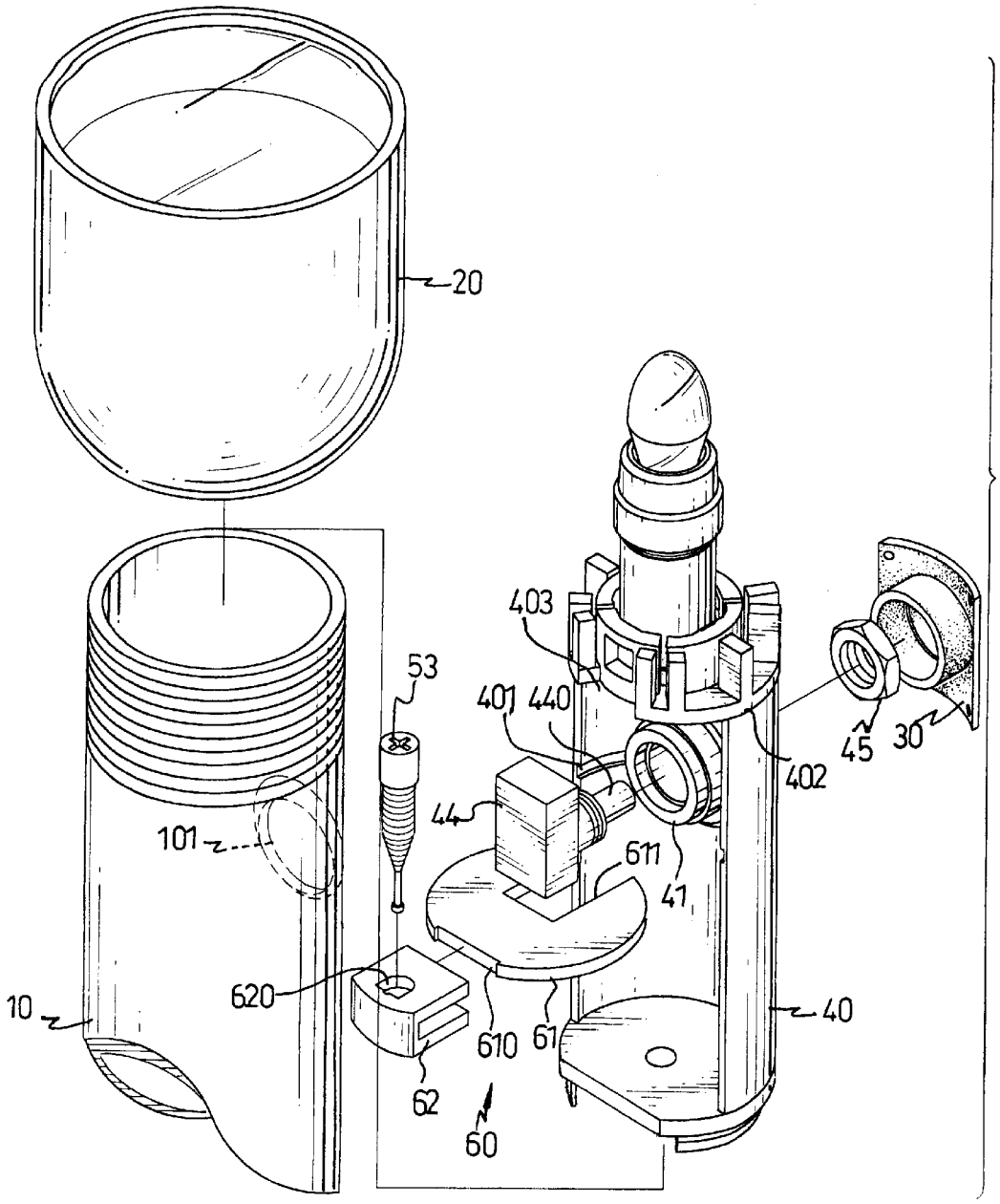
FIG. 4 is an exploded perspective view of another preferred embodiment constructed in accordance with the present invention.

Referring further to FIG. 4, if the flashlight has only one switch, the basic structure of the waterproof switch is the same as what has been described. The only difference lies in that the waterproof bonnet (30) has only one arcuate surface (31) with a rim (33) oppositely extending out therefrom. Accordingly, the switch assembly (40) has only one hole (41) defined to correspond to the arcuate surface (31) of the waterproof bonnet (30) and a flange (401) formed on an inner periphery of the switch assembly (40). The abutting member (60) includes a plate (61) detachably engaged with the inner periphery of the switch assembly (40 and having a notch (611) defined to receive therein a switch (44) with an extension (440) extending into the hole (41) and a flat side (610) and a forcing member (62) detachably having the plate (61) received therebetween and having a passage (620) defined therethrough. With such an arrangement, when the waterproof switch of the invention is assembled, the arcuate surface (31) of the waterproof bonnet (30) aligns with the hole (41), the extension (440) of the switch (44) is received in the hole (41) and the plate (61) has the switch (44) received in the notch (611). Thereafter, the enlarging element (53) extends into the passage (620) to force the forcing member (62) to leave the engagement with the plate (61). While the enlarging element (53) continues to extend into the passage (620), one side of the forcing member (62) will abut an inner periphery of the cylinder (10) of the flashlight and when the forcing member (62) securely abuts the inner periphery of the cylinder (10) and the enlarging element (53) still continues to extend into the passage (620), the enlarging element (53) will then abut the flat side (610) of the plate (61) and force the plate (61) to move toward the waterproof bonnet (30). Because the waterproof bonnet (30) is made of a resilient material, such as silicon, the abutment of the plate (61) will force the waterproof bonnet (30) to have a water tight engagement with the periphery defining the hole (41). Therefore, because of the waterproof bonnet (30), the water tight engagement within the switch assembly (40) is achieved and a waterproof switch in a flashlight is accomplished.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A waterproof switch in a flashlight, the waterproof switch comprising:

a switch assembly received in a hollow cylinder of the flashlight and having at least one hole defined therethrough, at least one switch with an extension extending into the at least one hole, a plate securely engaged with an inner periphery of the switch assembly, a forcing member detachably engaged with the plate to force the switch assembly to move toward the cylinder of the flashlight; and a waterproof bonnet sandwiched between the cylinder of the flashlight and an outer periphery of the switch assembly and having at least one arcuate surface protruding out from at least one through hole defined in the cylinder and at least one rim extending oppositely to the at least one arcuate surface and into the at least one hole of the switch assembly.

2. The waterproof switch as claimed in claim 1, wherein the forcing member has a passage defined to receive an enlarging element therethrough.

3. The waterproof switch as claimed in claim 2, wherein the enlarging element has a large diameter portion, a medium portion and a small diameter portion thereby allowing the forcing member to abut an inner periphery of the cylinder and the plate of the switch assembly to secure the waterproof bonnet between the switch assembly and the cylinder when the enlarging element extends into the passage.

4. The waterproof switch as claimed in claim 2, wherein a retainer is used to secure the extension of the switch after the extension is inserted into the hole of the switch assembly.

5. A waterproof switch in a flashlight, the waterproof switch comprising:

a switch assembly received in a hollow cylinder of the flashlight and having at least one hole defined therethrough, at least one switch with an extension extending into the at least one hole, a waterproof bonnet received between the cylinder of the flashlight and the switch assembly; and an abutting member received between an inner periphery of the cylinder and the switch assembly and forcing the switch assembly to move toward the inner periphery of the cylinder so as to allow the switch assembly to have a water tight engagement with the cylinder;

wherein the abutting member has a plate securely engaged with an inner periphery of the switch assembly, a forcing member having the plate received therebetween and a passage defined therethrough; an enlarging element extending into the passage to force the forcing member to abut the inner periphery of the cylinder and the plate; and wherein a retainer is used to secure the extension of the switch after the extension is inserted into the at least one hole of the switch assembly.

6. The waterproof switch as claimed in claim 5, wherein the waterproof bonnet has at least an arcuate surface aligned with the at least one hole defined in the switch assembly and a rim oppositely formed to the arcuate surface and extending into the at least one hole in the switch assembly.

7. A waterproof switch in a flashlight, the waterproof switch comprising:

a switch assembly received in a hollow cylinder of the flashlight and having at least one hole defined therethrough, at least one switch with an extension extending into the at least one hole, a waterproof bonnet received between the cylinder of the flashlight and the switch assembly; and an abutting member received between an inner periphery of the cylinder and the switch assembly and forcing the switch assembly to move toward the inner periphery of the cylinder so as to allow the switch assembly to have a water tight engagement with the cylinder, wherein the abutting member has a plate securely engaged with an inner periphery of the switch assembly, a forcing member having the plate received therebetween and a passage defined therethrough; an enlarging element extending into the passage to force the forcing member to abut the inner periphery of the cylinder and the plate.

8. The waterproof switch as claimed in claim 7, wherein the enlarging element has a large diameter portion, a medium portion and a small diameter portion thereby allowing the forcing member to abut an inner periphery of the cylinder and the plate of the switch assembly to secure the waterproof bonnet between the switch assembly and the cylinder when the enlarging element extends into the passage.

9. The waterproof switch as claimed in claim 7, wherein a retainer is used to secure the extension of the switch after the extension is inserted into the at least one hole of the switch assembly.

* * * * *